United States Patent [19]

Mekelburg

[11] 3,955,236

[45] May 11, 1976

[54] COLLECTOR SYSTEM IN A VACUUM SWEEPER CIRCUIT

[75] Inventor: Clayton G. Mekelburg, Lakewood, Colo.

[73] Assignee: Richard W. Burt, Jr., Lakewood, Colo.

[22] Filed: July 26, 1974

[21] Appl. No.: 492,006

[52] U.S. Cl. ..... 15/314; 15/340; 15/352; 15/353; 55/319; 55/337; 55/358; 55/385 B; 55/433; 55/467; 55/482; 55/498; 55/502; 55/503; 55/DIG. 3

[51] Int. Cl.[2] ..... E01H 1/08; B01D 50/00

[58] Field of Search ..... 15/340, 347, 348, 314, 15/315, 349, 353, 352; 209/143, 144; 55/315, 319, 329, 330, 337, 356, 358, 411, 412, 432, 433, 467, 482, 483, 328, 484, 498, 500, 501, 502, 385 B, 503, DIG. 3

[56] References Cited

UNITED STATES PATENTS

| | | | |
|---|---|---|---|
| 1,930,806 | 10/1933 | Horne et al. | 55/358 X |
| 2,231,352 | 2/1941 | Shoemaker | 15/340 X |
| 2,724,904 | 11/1955 | Gordon | 55/315 X |
| 2,772,438 | 12/1956 | Diaz | 15/340 X |
| 2,792,910 | 5/1957 | Redniss | 55/459 X |
| 2,990,032 | 6/1961 | Sandvig | 55/498 X |
| 3,192,853 | 7/1965 | O'Connor | 55/459 X |
| 3,404,776 | 10/1968 | Shaddock | 209/144 X |
| 3,470,680 | 10/1969 | Avera | 55/500 X |
| 3,472,002 | 10/1969 | Brown et al. | 55/501 |
| 3,594,848 | 7/1971 | Atkinson | 15/340 X |
| 3,633,753 | 1/1972 | Petitjean | 55/500 X |
| 3,695,012 | 10/1972 | Rolland | 55/337 X |
| 3,842,461 | 10/1974 | Wurster | 55/319 X |

FOREIGN PATENTS OR APPLICATIONS

| | | | |
|---|---|---|---|
| 631,580 | 5/1936 | Germany | 55/337 |
| 830,876 | 10/1938 | France | 15/340 |

*Primary Examiner*—Frank W. Lutter
*Assistant Examiner*—David L. Lacey
*Attorney, Agent, or Firm*—Richard D. Law

[57] ABSTRACT

An airtight container, having two separated compartments, including an inlet to the first compartment and a flexible, gravel pick-up tube attached to the inlet. A cyclone separator is mounted on the second compartment with its separated particle outlet discharging into the second compartment. A connecting conduit connects the outlet of the first compartment with the inlet of the cyclone, so that the first compartment is a separator for gravel and dust and the second compartment is a dust container for the cyclone. A separate, high capacity air pump has its inlet connected to the cyclone's clean air outlet causing a flow of air through the unit for picking up gravel and dust through the flexible tube. For convenience the containers may be mounted on a truck, and both containers are unloaded through a common, sealable gate at the lower portion of the containers.

3 Claims, 9 Drawing Figures

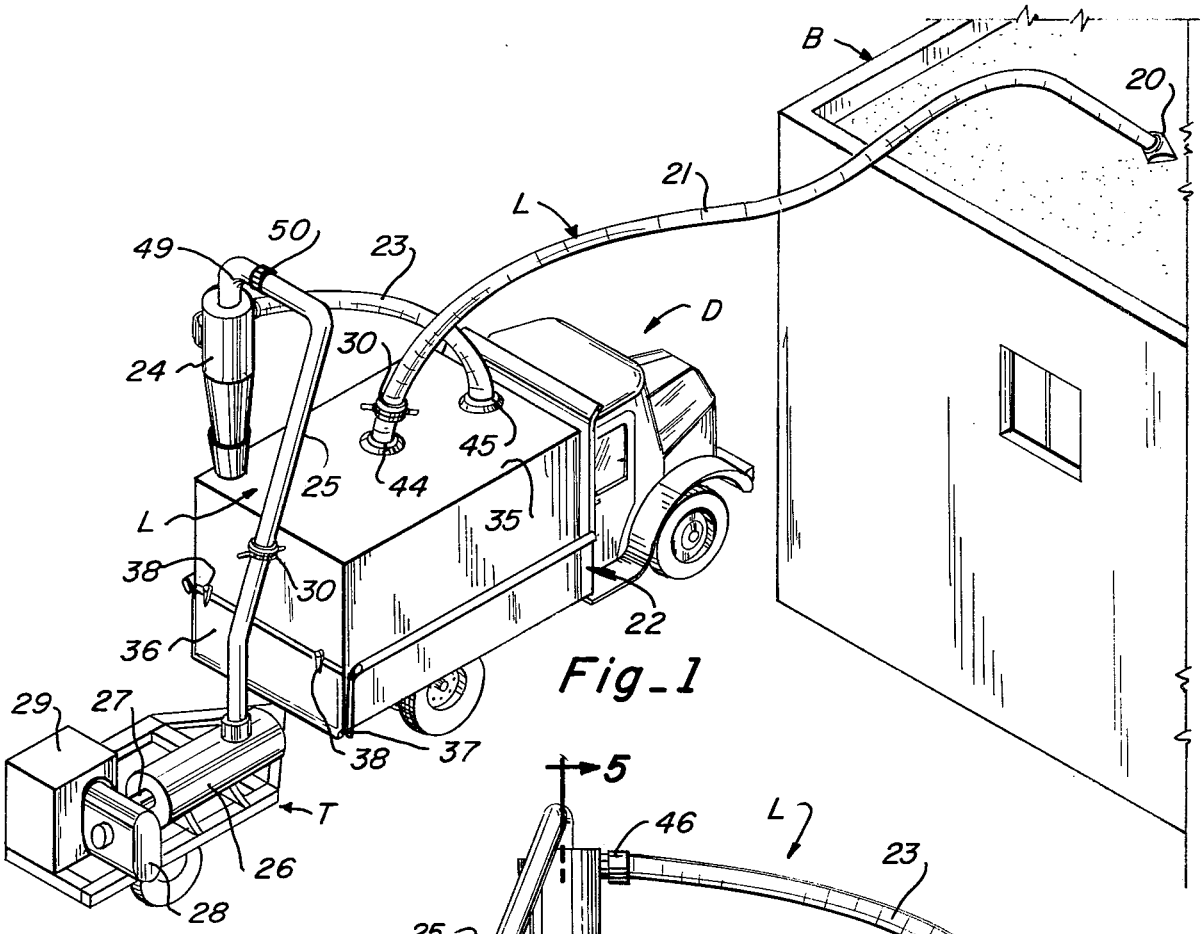
Fig_1
Fig_9
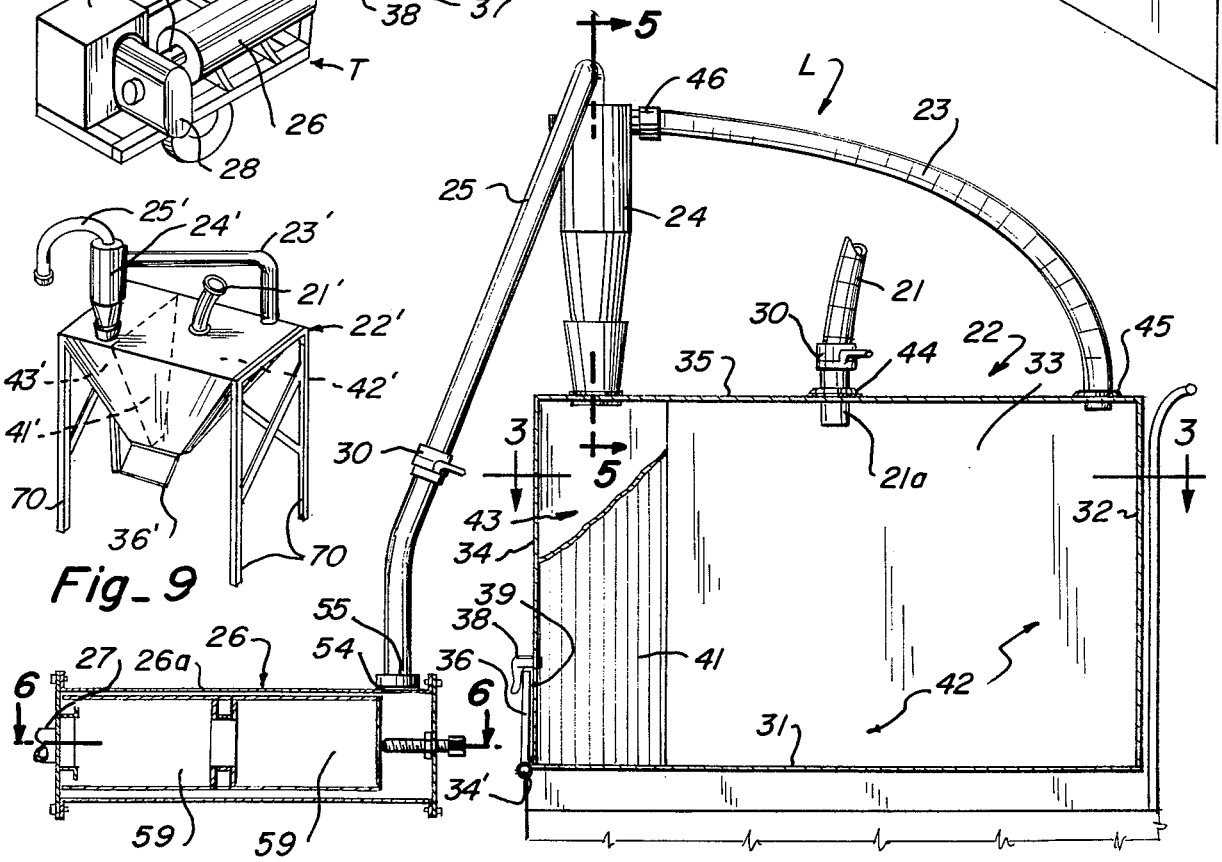
Fig_2

COLLECTOR SYSTEM IN A VACUUM SWEEPER CIRCUIT

The present invention relates to vacuum sweepers, and more particularly to the collector systems within heavy duty vacuum sweepers used for industrial purposes.

A primary object of the invention is to provide a vacuum sweeper which is especially useful in picking up loose particles such as gravel from surfaces whereon a considerable amount of fine dust has collected and which includes a novel and improved collector system in the vacuum circuit which is capable of effectively retaining both the particles and the dust. As such, the invention will be called "A Collector System in a Vacuum Sweeper Circuit."

While the present invention is ideally suited for many types of industrial uses where it is necessary to remove both particles and dust from the surfaces being swept, the paramount commerical use for the invention resides in sweeping commercial, asphalt-coated types of flat roofs so that they may be repaired. Such roofs, mostly on commercial buildings, are built according to a standard procedure where layers of asphalt saturated felt are laid upon the roof surface and cemented together with a coating of hot-mop asphalt or tar with the top layer being a comparatively thick coating of hot-mop asphalt or tar covered with a layer of small generally uniform rocks such as pea gravel or the like. The rocks forming the layer of gravel embed themselves into the asphalt to protect the roof covering, the asphalt and the felt sheets therebelow, against physical damage and weather deterioration especially by sunlight.

A good average life for such a roof may be approximately ten years, at which time it must be repaired and rehabilitated. The repair procedures which have become quite standardized include removing the gravel cover, which is mostly loosened from the asphalt coating by that time. Also, it is necessary to remove the dust and dirt which has accumulated on the roof, over its life. The dust and dirt is deposited from an airborne condition and it can become quite a problem. The common procedure for removing the rock and dust is by sweeping the roof with heavy brooms. This is a very onerous, slow chore where the workmen will get very dirty, especially on a hot day, and they are usually required to wear masks because of the large amounts of fine dust which are stirred up by the sweeping and dumping the gravel from the roof to a truck. The dust is, also, almost always objectionable to other people in the vicinity of the building.

There is a real and definite need for improved systems for cleaning the gravel and dust accumulations from the asphalt-coated type of roof such as is commonly found in most industrial buildings throughout the country. The present invention was conceived and developed with such a need in view, and this invention comprises, in essence, a large, heavy duty vacuum sweeper having within its vacuum circuit a novel and improved collector system, which combines a receiving and transportation bin, a cyclone and a filter in an arrangement which will effectively and efficiently direct the flow of air through the vacuum sweeper to sequentially deposit gravel and dust and thereafter, filter from the air all very fine particles and dust not deposited to provide a comparatively clean air discharge from the system.

It follows that another object of the invention is to provide a novel and improved collector system for a vacuum sweeper which is especially adapted for cleaning gravel and dust from an asphalt-coated type roof surface preliminary to repairing the surface.

Another object of the invention is to provide a novel and improved collector system in a vacuum sweeper circuit including a container unit which will collect particles and dust in an efficient manner and which can be carried upon a dump truck or a like vehicle to provide for an easy mode of disposing of the particles and dust collected in the unit.

Yet another object of the invention is to provide a collector system for a vacuum sweeper which will more effectively retain both large particles, such as gravel, and fine particles, such as dust, in a single disposable container by compartmenting the container to separate the different sizes of particles and prevent recirculation of dust particles.

Another object of the invention is to provide in a collector system for a vacuum sweeper, a novel and improved arrangement for mechanically dropping large particles such as gravel and also, most of the finer particles of dust to such an extent that a final filter may be used to completely clean the air before permitting it to discharge to the atmosphere and this final filter can operate for substantial time periods without clogging and requiring cleaning.

Yet another object of the invention is to provide in combination with a collector system for a vacuum sweeper, a simple, efficient, easily maintained, final filter to prevent very small particles from being discharged into the air.

Other objects of the invention are to provide in a collector system for a vacuum sweeper a simple, economical, effective, easily maintained, rugged and durable system.

With the foregoing and other objects in view, my present invention comprises certain constructions, combinations and arrangements of parts and elements as hereinafter described, defined in the appended claims and illustrated in preferred embodiments by the accompanying drawings in which:

FIG. 1 is a small scale, somewhat diagrammatic, isometric view of a vacuum sweeper being used for sweeping a roof having the improved collector system in its circuit constructed according to the invention;

FIG. 2 is a side elevational view of the collector system components of the vacuum sweeper shown at FIG. 1, but on an enlarged scale and with wall sections of the containers being broken away to show arrangements and parts therewithin;

FIG. 9 is a small scale, somewhat diagrammatic perspective view of a modified embodiment of a collector bin comparable to the unit illustrated at FIGS. 1 – 8, but showing the same as being mounted upon an elevated framework.

Figure 3:
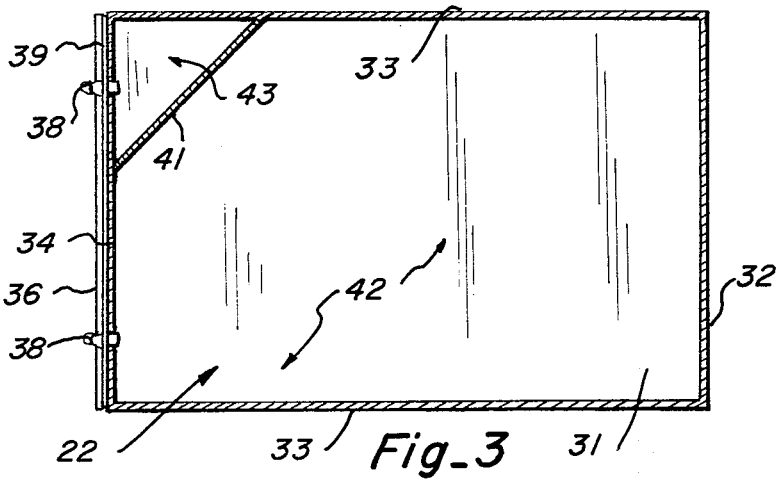
FIG. 3 is a sectional plan view of the primary collector bin as taken from the indicated line 3—3 at FIG. 2.
Figure 5:
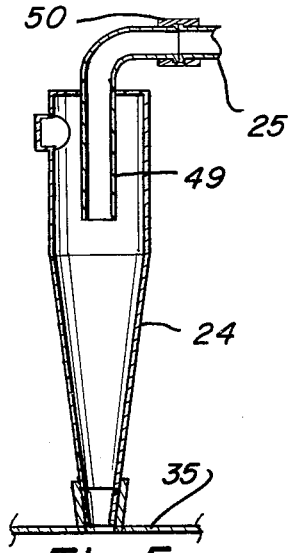
FIG. 5 is a sectional elevational view as taken from the indicated line 5—5 at FIG. 2.

Referring more particularly to FIGS. 1 to 8 of the drawings, the apparatus for cleaning the gravel from the roof of a building B, constructed according to the present invention, is a vacuum sweeper having the several improved components of the collector system in the sweeper circuit which consists of a 2, 3 or 4 inch line L having flexible portions and rigid portions and is sufficiently long so that it may extend from a gravel and dirt separating system to the deck of a building. Commencing at a pickup head 20 which is used by an operator on the roof of the building B, a first reach 21 of a flexible line L extends to a rock collecting container 22 of the collector system which is conveniently carried upon a dump truck D. A second reach 23 of the line extends from the rock collecting container 22 to a cyclone separator 24 which is adapted to drop dust into a special compartment within the rock collecting container as hereinafter described. A third reach 25 of the line extends from the cyclone exhaust to a final filter 26 and a short fourth reach 27 of the line from the filter terminates at a vacuum pump 28 (air blower using the intake side for vacuum) and the discharge from this vacuum pump is to the atmosphere. The vacuum pump 28 is driven by a suitable engine indicated at 29, and to provide a convenient portable apparatus, the final filter and the vacuum pump are carried upon a trailer T which may be towed by the dump truck D when moving from one location to another.

It will be necessary to operate the dump truck carrying the rock collecting container 22 independently of the filter 26 and vacuum pump 28 on the trailer, as when a load of gravel and dust picked up from a roof must be transported to a disposal site as hereinafter described. Accordingly, suitable disconnect couplings 30 are provided on the first line reach 21, from the container to the pickup head, and the third line reach 25, from the container to the filter, to quickly disconnect these lines from the truck so that the truck may travel independently of the line 21 and the trailer T.

The first line reach 21 which extends to the pickup head will be a flexible, lightweight hose of any suitable conventional type which is commonly used with commercial vacuum cleaning operations and it is to be noted that this line reach may be from 50 to 100 feet long, or such, so that it can be extended to the roof of a building B several stories high. The pickup 20 at the intake of this line will ordinarily include a rigid, lightweight handle and a head formed of any suitable conventional type which will facilitate the picking up and movement of gravel and dust into the line responsive to the inflow of air thereinto.

The rock collecting container 22 is formed as a box-like structure proportioned to fit in the bed of a conventional dump truck and this container is formed as an enclosed sheet metal structure having a bottom 31, front end wall 32, side walls 33, a rear end wall 34 and a top 35. The container, made of sheet metal, is suitably welded together as a gastight, unitary structure and it may include reinforcement members, such as angles, at its several walls to resist the crushing forces imposed upon this structure by the air pressure differential between the outside and inside of the container when the vacuum sweeper is in operation. Such angles or other reinforcements across these several walls are not shown in the drawing since they are conventional in the construction of vacuum containers, and whether or not they will be needed is a matter easily ascertained by a skilled designer of the system.

The rear end wall 34 includes an opening 34' across its bottom portion which is normally closed by a hinged discharge gate 36. This gate may be opened to permit the contents of the container to be discharged from it by tipping the dump truck wherein the container is mounted. The gate is pivoted by a hinge 37 along the bottom edge of the container and is normally held closed by suitable latches 38 on the rear wall above the discharge opening 34'.

Figure 4:
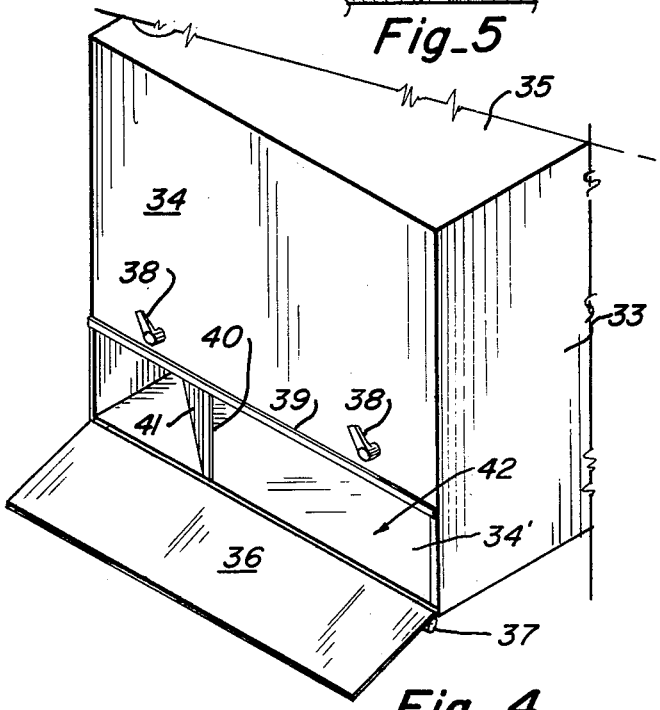
FIG. 4 is a fragmentary isometric view of the rear end of this primary bin with the discharge gate being open.

Since the system will operate under a vacuum, it becomes important to prevent air leaks as at the gate 36. Accordingly, the opening 34' will be edged with a continuous strip seal 39, of a suitable resilient material such as foam rubber. Not only will this seal extend about the periphery of the opening, but also a seal portion 40, bearing against the closed gate, will lie at the edge of a partition wall which forms a compartment at one corner of the container as best illustrated at FIG. 4. This effectively forms two separated containers when the gate is closed.

To complete the rock collecting container 22, a diagonally positioned partition 41 at a rear corner of the container divides the container into a major compartment 42 wherein small rocks and similar particles will be collected, and a minor, corner compartment 43 wherein dust will be collected, the cyclone 24 heretofore mentioned being located on the top of the container directly over the minor compartment to drop dust thereinto. It is to be noted that with the minor compartment 43 being located at a rear corner of the container, the discharge gate 36 will also open this compartment as illustrated at FIG. 4 as well as the major compartment 42, so that both gravel and large particles in the major compartment, and dust in the minor compartment will be discharged from the container at the same time.

The first and second reaches 21 and 23 of the vacuum line L and the cyclone separator 24 are located on the top 35 of the container 22. Accordingly, a first reach of the vacuum line which extends from the intake end of the system at the pickup head 20 to the container will drop into the major compartment 42, preferably at the center of the container. The line 21 will be connected to the top of the container by suitable flange 44 and may terminate at the edge of the container top or extend a short distance into the major compartment as at 21a at FIG. 2. With this arrangement, with the air flow from the intake through the first reach of the line and into the container, all of the rocks and heavy particles picked up by the head 20 at the intake of the vacuum system will be dropped into the container so that only dust can be discharged from this major compartment of the container through the second reach 23 of the line L and to the cyclone 24.

This second reach 23 of the vacuum line L extends from the top 35 of the container and to the cyclone separator. The line may be a lightweight, rigid tube or lightweight, flexible conduit such as will be used for the first reach 21 of the line. It will connect to the container top 35 by a suitable flange 45 and connect with an intake pipe stub of the cyclone separator by a suitable coupling 46. By placing the end of this second reach 23 of the line and the cyclone at the top of the container, as heretofore mentioned, the upward flow of air into the second reach will prevent any large particles from moving into the cyclone.

The cyclone separator 24 is essentially a conventional unit formed as an upright cylindrical structure with the lower portion conically converging to connect with and drop dust removed from the air stream into the bottom of the cyclone and into the minor compartment 43. The intake 48 to this cyclone is tangentially located near the top of the cylindrical wall to cause air moving thereinto, from the line section 23, to swirl about the wall of the cylinder to cause dust to move against this wall through centrifugal action and thereafter drop to the bottom of the conical section. The discharge from this cyclone is upwardly through an axially centered tube 49 which turns and connects with the third reach 25 of the line L as by a coupling 50.

With this cyclone all but the finest dust particles will drop into the minor compartment 43 whenever the vacuum system is in operation. It is to be noted that during operation of the system, with the suction action taking place at the vacuum pump 28, there will be a head loss in the air line in addition to the pressure dorp required to attain a high velocity of air flow through the line. Accordingly, the reduced pressure within the cyclone separator will be accompanied by an expansion of the air to the point where this rarified air will have a significantly reduced viscosity, permitting even small dust particles to rapidly fall out of the swirling air flow within the cyclone.

Figure 6:
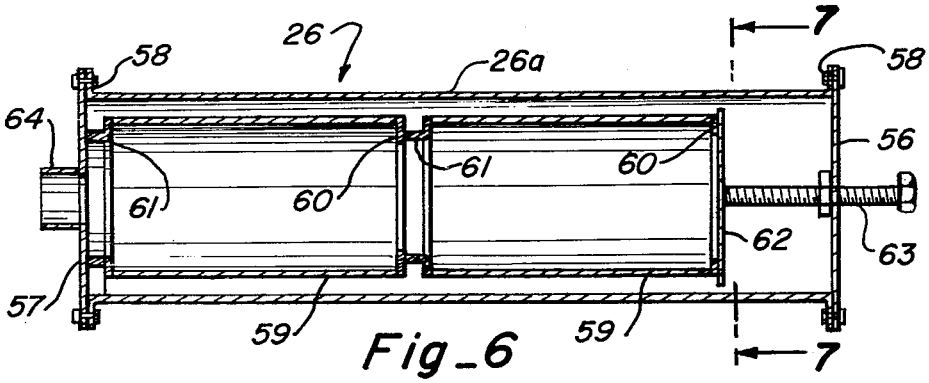
FIG. 6 is a sectional plan view of the final filter section of the system as taken from the indicated line 6—6 at FIG. 2, but on an enlarged scale.

The air flow from the cyclone and into the third reach 25 of the line L enters the final filter 26, a cylindrical shell, the line being connected to a stub 54 in the side, and near one end, of the final filter by a coupling 55, as shown at FIG. 2. The filter 26, a cylindrical chamber 26*a*, has its ends closed by circular end plates 56 and 57. As illustrated at FIG. 6, these end plates are bolted onto flanges 58 at each end of the cylindrical body 26 of the filter and it is contemplated that the bolts at one end of this flange can be easily removed to permit the filter elements therewithin to be quickly changed.

Figure 8:
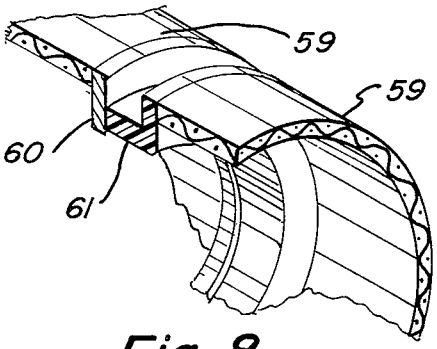
FIG. 8 is a fragmentary isometric view of portions of the two filter elements shown at FIG. 6, but on an enlarged scale.

In the unit illustrated, two cylindrical filter elements 59 are used, each element being formed as a cylindrical, tubular member somewhat smaller in diameter than the body of the filter 26*a*. The cylindrical walls of these filter elements are formed of a suitable, rigid, porous material (paper over support screening) which will withstand a moderate degree of compressive forces. An inturned flange 60 is formed at one end of the filter element which is of a rigid material, while a resilient inturned L-shaped coupling section 61 is formed at the other end of the filter element which is adapted to abut against the inturned flange of the other filter element as shown at FIG. 8 or against a wall of the end plate 57.

Figure 7:
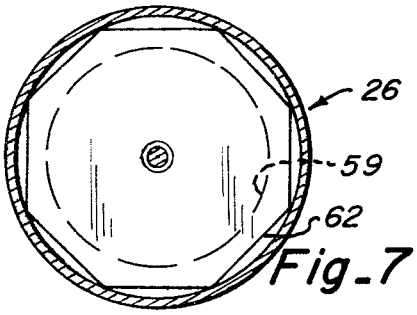
FIG. 7 is a sectional view as taken from the indicated line 7—7 at FIG. 6, but on an enlarged scale.

The two filter elements 59 are concentrically mounted within the cylindrical filter chamber 26, in tandem, with the end of one element abutting against the end plate 57. The other end of the filters is held in place by a pressure plate 62 and this end is located adjacent to the connection of the third reach 25 of the line L, at the stub 54. Air entering the filter must flow past this pressure plate 62 and accordingly, it is formed as a regular polygon, as shown at FIG. 7, to bypass air about its periphery and at the same time, automatically center itself in the cylindrical shell 26. It is to be noted that this plate may be formed with scallops or other configurations which will function in a like manner. This pressure plate is held against the filters by a set screw 63 axially threaded into the end plate 56 to bear against the pressure plate 62 as best illustrated at FIG. 6. To complete this filter, an axially centered pipe stub 64 is located at the opposite end plate 57 to connect with the fourth reach 27 of the line L which, in turn, connects with the vacuum pump 28.

The operation of this apparatus is manifest from the foregoing description. When the vacuum sweeper is in operation, a flow of air into the pickup head 20, through the first reach of the line L, discharges into the major compartment of the container 22. This compartment functions as an enlargement in the passageway to reduce the velocity of the airflow and to drop all large particles picked up by flow through the line. The flow from the compartment into the second reach 23 of the line and to the cyclone separator will carry only light weight dust, most of which is dropped out of the system by the cyclone separator 24 into the minor compartment of the container 22 while the air cleaned of all but the finest particles of dust will flow to and through the filter elements 59 of the final filter 26 and then be discharged to the atmosphere by the pump 28. Preferably, the air pump is a high volume unit arranged so that on a 2-inch line it pulls at least about 800 scfm on an open inlet. This insures a complete pickup of the gravel. The pump must be increased in size, of course, as the lines are increased in size so as to provide an equivalent air flow through the lines. The engines for driving the air pump must, of course, be adequate to drive the pump at the optimum rpm, even at a closed off condition of the line. The engine may advantageously be a gasoline engine of sufficient horsepower, providing the motivating power independently of the building or its services. Alternatively, where electric power is available, a sufficiently high horsepower motor to run the air pump may be used.

The basic arrangement shown in FIGS. 1–8, may, also, be used in conjunction with structural arrangements other than that hereinabove described and a modified embodiment of the invention to illustrate this is shown at FIG. 9 wherein the compartment 22′ is formed as a closed, hopper-like structure mounted upon a structural standard 70 in an arrangement which permits a dump truck or the like to move underneath the hopper to receive rocks and dust accumulated in this hopper. As such, the discharge gate 36′ of the hopper is preferably located at the bottom of the unit. However, the other compartments within and connecting to this hopper are essentially the same as heretofore described. A partition wall 41′ divides the interior of the hopper into a major compartment 42′ wherein rocks are dropped and a minor compartment 43′ wherein the dust is dropped. The line reaches, as indicated, will include a first reach 21′ whereon the pickup line is connected; a second reach 23′ extending from the major compartment 42′ to a cyclone 24′ and a third reach 25′ which extends to the final filter as hereinbefore described.

I have now described my inventon in considerable detail. However, it is obvious that others skilled in the art can build and devise alternate and equivalent constructions which are nevertheless within the spirit and scope of my invention. Hence, I desire that my protection be limited not by the constructions illustrated and described, but only by the proper scope of the appended claims.

I claim:

1. In a vacuum cleaner circuit having a vacuum line extending from a pickup head at the intake of the line and an air pump at the exhaust of the line, a collector system to collect dust and rocks picked up at the intake of the line to remove the same from air flowing through the system before the air is discharged from the air pump, comprising in sequence:

a. a first separate compartment connected to a first reach of the vacuum line formed as a closed chamber having a closable outlet for rocks collected therefrom, wherein the first reach of the vacuum line from the pickup head is so connected so as to drop the rocks and like particles thereinto and to discharge air and dust in a second reach of the vacuum line extending from the first compartment;

b. a cyclone separator connected to the second reach of the line extending from the first compartment to separate dust particles from the airflow as it passes through the cyclone whereby to discharge substantially dust-free air through its clean air outlet into a third reach of the line connected to said clean air outlet of the cyclone;

c. a second separate compartment having a closable discharge outlet connected with the discharge of the cyclone to receive dust separated by the cyclone;

d. a filter connected to a third reach of the line extending from the cyclone and to the air pump whereby to remove any fine particles of dust which may pass through the cyclone separator;

e. means associated with both the discharge outlets of the first compartment and the second compartment to periodically discharge the rocks and dust collected in the respective compartments, said first and second compartments are formed within a single, box-like container with a closed top having the aforesaid first reach of the line entering said first compartment through the top thereof, whereby to facilitate the dropping of rocks and heavy particles picked up by the system into this compartment, and the aforesaid discharge means comprises a single gate opening both compartments when the gate is opened, and the second-mentioned reach of the line extending from the first compartment to the cyclone separator extends from the aforesaid top of the container, and the cyclone is positioned at the top of the container over the aforesaid second compartment to facilitate dropping dust separated by the cyclone directly into the second compartment.

2. The organization defined in claim 1 wherein:

the container is proportioned as a rectangular, box-like structure of a size adapted to be mounted upon the bed of a dump truck and said single gate is at the bottom of said container and located at an end wall of said compartments; and disconnect means in the first and third reaches of the line sections to permit the air pump and the first reach of the vacuum line to be disconnected from the container away from the system as for disposing of its contents in said container.

3. In the organization defined in claim 1, wherein:

the container is formed as a hopper-like structure mounted upon a standard and wherein the aforesaid gate is at the bottom thereof to permit the contents within the container to drop therefrom whenever the gate is opened.

* * * * *